US007736463B1

(12) United States Patent
Zhang et al.

(10) Patent No.: US 7,736,463 B1
(45) Date of Patent: Jun. 15, 2010

(54) METHOD FOR MANUFACTURING BLEACHED MECHANICAL AND CHEMITHERMOMECHANICAL PULP

(75) Inventors: Eric Yijing Zhang, Norrtalje (SE); Micael Axelfelt, Hargshamon (SE); Sverker Bengtsson, Hallstarik (SE); Charlotte Wancke Stahl, Taby (SE); Johanna Magnusson, Uppsala (SE)

(73) Assignee: Holmen Aktiebolag, Stockholm (SE)

( * ) Notice: Subject to any disclaimer, the term of this patent is extended or adjusted under 35 U.S.C. 154(b) by 0 days.

(21) Appl. No.: 09/914,650

(22) PCT Filed: Mar. 7, 2000

(86) PCT No.: PCT/SE00/00452

§ 371 (c)(1),
(2), (4) Date: Feb. 27, 2002

(87) PCT Pub. No.: WO00/53844

PCT Pub. Date: Sep. 14, 2000

(30) Foreign Application Priority Data

Mar. 8, 1999 (SE) ..... 9900816

(51) Int. Cl.
*D21B 1/16* (2006.01)

(52) U.S. Cl. ..... 162/24; 162/25; 162/26; 162/28; 162/55; 162/65; 162/68

(58) Field of Classification Search ..... 162/24, 162/25, 26, 55, 83, 68, 28
See application file for complete search history.

(56) References Cited

U.S. PATENT DOCUMENTS 3,186,899 A * 6/1965 Madison et al ..... 162/24
3,467,574 A * 9/1969 West ..... 162/24
4,030,969 A 6/1977 Asplund et al.
4,718,980 A * 1/1988 Lowrie et al. ..... 162/78
4,863,564 A * 9/1989 Grimsley et al. ..... 162/53

FOREIGN PATENT DOCUMENTS

| | | |
|---|---|---|
| EP | 0 155 928 | 9/1985 |
| JP | 57-005992 A | 1/1982 |
| WO | WO 87/03022 | 5/1987 |
| WO | WO 87/05954 | 10/1987 |

OTHER PUBLICATIONS

Webster's Third New International Dictionary, Unabridged, 1993, Merriam-Webster, Incorporated.*
Smook, G.A., Handbook for Pulp & Paper Technologists, TAPPI, 1982, pp. 161, 171.*

* cited by examiner

*Primary Examiner*—Mark Halpern
(74) *Attorney, Agent, or Firm*—Sughrue Mion, PLLC

(57) ABSTRACT

A method of manufacturing bleached mechanical and chemithermomechanical pulp is provided, having enhanced bleaching effect, wherein lignocellulose material is passed through at least one preheater or through a chemical treatment system, a steam separator and a refiner where the lignocellulose material is converted into a pulp suspension which, after steam separation, is passed at least to a storage vessel and to a screening department, from which the major part of the pulp suspension is separated as a substantially finished product or is separated and further treated. The reductive bleaching agent is added to the advancing pulp suspension without a bleaching tower. The method is characterized by adding the bleaching agent at a location downstream of the refiner and upstream of the screening department, and by bleaching the pulp under drastic conditions of temperature and minimized oxygen access at the location and immediately downstream of the location.

13 Claims, 1 Drawing Sheet

METHOD FOR MANUFACTURING BLEACHED MECHANICAL AND CHEMITHERMOMECHANICAL PULP

This application is a 371 of PCT/SE00/00452 filed 7 Mar. 2000.

TECHNICAL FIELD

The present invention relates to a method for manufacturing bleached mechanical and chemithermomechanical pulp. By mechanical pulp is meant chiefly a pulp with which the fibres in the incoming lignocellulose material are defibrated by means of one or more refiners, for instance in accordance with the thermomechanical pulp manufacturing process. Large parts of the chemithermomechanical pulp manufacturing process are similar to the thermomechanical pulp manufacturing process. The main difference lies in treating the lignocellulose material, normally wood chips, with a sodium sulphite solution in a first stage, for instance at a certain temperature and over a certain period of time. Consequently, the pulp yield will usually be one or some percent lower than in the case of thermomechanical pulp. Any lignocellulose material whatsoever can be used as starting material. Examples of such materials are bamboo, straw, bagasse, kenaf and wood. Wood is the preferred starting material, and both softwoods and hardwoods can be beneficially used, either separately or in combination. The wood is normally chopped initially in the pulp manufacturing process into an indeterminate number of chips.

Any known refiner or refiners can be used to defibrate the fibres. The majority of refiners comprise two refining discs, between which the material to be treated is caused to pass. Normally, one disc remains stationary whilst the other rotates at high speed. In another type of refiner, the two refining discs are counter-rotational. A third type of refiner comprises four refining discs in which a centrally placed rotor has refining discs mounted on both sides thereof.

The pulp can be bleached with any known reducing bleaching agent. Examples of such bleaching agents are dithionite (which is sometimes called hydrosulfite and which is preferred), borohydride, hydrazine and formamidine sulfinic acid.

According to the invention, it is not necessary to bleach the pulp in addition to treatment with a reducing bleaching agent, although the pulp may be bleached further in one or more stages with the aid of an oxidizing bleaching agent, such as some peroxide, or with a reducing agent such as dithionite.

BACKGROUND ART

It is known to use an oxidizing bleaching agent, primarily some peroxide, and a reducing bleaching agent, primarily dithionite, in the manufacture of bleached mechanical pulp, for instance thermomechanical pulp. It is also known to bleach one and the same mechanical pulp with both types of bleaching agent, i.e. in an oxidizing bleaching stage followed by a reducing bleaching stage, or vice versa.

This also applies to the manufacture of chemithermomechanical pulp. Peroxide, normally hydrogen peroxide, is a highly effective bleaching agent that bleaches the pulp to high brightness. However, peroxide bleaching normally requires the use of separate bleaching towers and also other bleaching plant equipment, which results in high capital investment costs.

Concerning reductive bleaching agents and then primarily dithionite—normally sodium dithionite—besides the use of bleaching tower the bleaching agent can be added directly to the pulp suspension, for instance in a storage tower, therewith obviating the use of bleaching tower and other bleaching equipment. This latter alternative results in a lowering of the capital investment costs. Such known dithionite bleaching is normally effected in a temperature range of 40-60° C. In order to enhance the bleaching response, i.e. the bleaching efficiency, it has been suggested that the dithionite is charged directly to a refiner (see U.S. Pat. No. 5,129,987 owned by Joachimides et al, and a lecture entitled "Reductive Bleaching in Refiners", Tappi Pulping Conference 1998, pp. 509-515). This method of procedure leads to an increased bleaching efficiency in comparison with a typical dithionite bleaching process, but manifested also drawbacks in the form of scaling within the refiner and a tendency towards corrosion damage.

In order to be successful when bleaching pulp with, for instance, dithionite, it is necessary to check and control the pH-value of the pulp suspension, the access of air to the pulp suspension, which should be restricted to the greatest possible extent, and the presence of hazardous and undesired metals in the pulp suspension, for instance transition metals.

Transition metals, particularly iron and manganese, are detrimental to the bleaching of mechanical pulp with, e.g., as well hydrogen peroxide as dithionite. The presence of manganese ions in significant quantities is particularly serious when bleaching pulp with hydrogen peroxide, whereas it is the iron ions that are particularly harmful when bleaching pulp with dithionite. These transition metals are normally removed from or neutralized in the pulp and the pulp suspension, by complex-binding the transition metals with a complexing agent, for instance in the form of ethylenediaminetetraacetic acid (EDTA) and/or diethylene triamine pentaacetic acid (DTPA). It has also been suggested that a reducing chemical, such as sodium hydrosulfite or sodium sulphite for instance, is added to the pulp suspension in addition to a complexing agent. Successes have also been achieved by treating wood chips solely with a complexing agent and with both of the aforesaid chemicals.

DISCLOSURE OF THE INVENTION

Technical Problems

Although it is known that reductive bleaching agents can be used in order to significantly limit the capital investment costs of the bleaching process, the fact that these bleaching agents typically exhibit a limited bleaching effect results in a significant total bleaching cost. A limited bleaching effect also results in difficulties in achieving the very high brightnesses desired of bleached mechanical or chemithermomechanical pulps.

The Solution

The present invention provides a solution to these problems and relates to a method for manufacturing bleached mechanical and chemithermomechanical pulp which comprises passing lignocellulose material, preferably wood in the form of chips, through at least one preheater alternatively through a chemical treatment system, a steam separator and a refiner where the lignocellulose material is converted to a pulp suspension which, subsequent to steam extraction, is passed to at least one storage vessel (latency chest) and to a screening department, from which the major part of the pulp suspension is removed as a substantially finished product or is removed and passed to further treatment stages, wherein reductive bleaching agent is added to the advancing pulp suspension without the aid of a bleaching tower or the like and wherein the method is characterized by adding the bleaching agent at a location downstream of the refiner and upstream of the screening department, and by bleaching the pulp under the given drastic condition from the aspect of temperature and the given minimized oxygen access in respect of said location and immediately downstream of said location.

In one preferred embodiment of the invention, a complexing agent is added to the lignocellulosic material upstream of and/or in the refiner. Any known complexing agent can be used. Preferred complexing agents are the earlier mentioned ETDA and DTPA and nitrilotriacetic acid (NTA). Complexing agents may be used in mixture. Moreover, complexing agents may be divided and added to the lignocellulose material at two or more locations. The steam separator, normally a cyclone of some kind, and the refiner are examples of locations at which a complexing agent may be added. A suitable complexing agent charge is from 0.04-1 percent by weight calculated on dry starting material, for instance wood.

It is also possible to add a complexing agent to the pulp suspension at the same location at which the bleaching liquid is introduced into the pulp suspension, optionally in mixture with the bleaching liquor.

In one embodiment of the invention, subsequent to steam separation, which is preferably effected with the aid of some kind of cyclone, the pulp suspension is passed to a second refiner for further refining of the pulp (defibration) and thereafter to a further steam separation stage, preferably effected with the aid of some kind of cyclone. It is preferred to add complexing agent to the pulp suspension immediately upstream of and/or in the second refiner. With respect to a suitable complexing agent and a suitable charge, reference is made to what has earlier been said in this regard. When adding complexing agent in two batches, the charge, or amount, added on each occasion will normally be lower than when all complexing agent is added to the pulp suspension at one time only.

It is very usual in the manufacture of bleached thermomechanical pulp for instance, to treat the pulp suspension in a slusher (latency pulper) located immediately upstream of the storage vessel (latency chest). In this case, the pulp suspension is either transported from the steam separation stage downstream of the first and sole refiner, or from the steam separation stage downstream of the second refiner to said slusher.

The pulp suspension is normally transported with the aid of a pump placed immediately downstream of the slusher, through a pipe that leads to the storage vessel.

According to the invention, it is preferred to add the reductive bleaching agent to the pulp suspension precisely in this pump. However, the bleaching agent may be added to the pulp suspension at several other alternative locations while still achieving a very good bleaching effect.

The conduit that leads to the slusher may comprise a screw conveyor and the bleaching agent may be added to the pulp suspension in said conveyor. Dilution water is normally delivered to the slusher, and the bleaching agent may be added to said water, which is later delivered to the pulp suspension. Furthermore, the bleaching agent may be delivered directly to the slusher. It will be understood that the bleaching agent charge may be divided and delivered to the pulp suspension at two or more of the aforesaid locations, for instance.

The phrase "the advancing pulp suspension" used in the aforegoing and also in the main claim shall be given a wide meaning. This phrase shall not solely be seen to mean when the pulp suspension flows forwards in a conduit or a pipe, but also when the pulp suspension is held in a vessel and container, for instance in the form of slusher and storage vessel, since even in these latter cases the pulp suspension still moves forwards in the sense that it is fed into the vessel at one location and exits from said vessel in another location.

Examples of reductive bleaching agents that are suitable for use have already been recited in this document, and it will be apparent that dithionite is the preferred bleaching agent. Dithionite is commercially available primarily as sodium dithionite, i.e. $Na_2S_2O_4$. The bleaching agent concerned is introduced into the pulp suspension in the form of an aqueous solution, the concentration of which will suitably lie within the range of 20-120 g/l. The amount of bleaching agent added to the pulp suspension will depend, among other things, on the difficulty in bleaching the pulp in question and also on desired pulp brightness.

Pulp bleaching parameters such as temperature, time, pulp consistency, pH, etc., are mainly determined by the conditions that prevail naturally when producing thermomechanical pulp (TMP), as in the described case. At the aforesaid locations at which the bleaching agent is added to the pulp suspension, the temperature will, of course, be very high, e.g. 80-95° C., and the consistency of the pulp low, e.g. 2-4%. The bleaching time will be short as a result of this very high temperature among other things, and will probably range from a time span of some seconds up to some minutes. The bleaching time will probably also depend partly on the rate at which the pulp suspension flows at the location where the bleaching agent is added. The pH-value will naturally lie within the range of 4-7. In some cases, it may be advisable to adjust the pH-value by adding either an acid or an alkali to the pulp suspension at the location concerned. When using dithionite as a bleaching agent, the pH-value should lie from 4.5 and upwards, in order to achieve an optimal bleaching result. Although a pH-value as high as 8.5 can be used for bleaching purposes, a pH of this magnitude is less suitable for other reasons.

The bleached pulp suspension is transported directly to the screening department from the latency chest. Pulp screening will result in a flow of accept pulp and a flow of reject pulp. The weight distribution between the two pulp flows will vary, among other things depending on how the pulp was produced, for instance whether one or two refining stages were used. It is not unusual for about 40% of the pulp entering the screening department to be taken out in the form of reject pulp.

The accept pulp can be passed to a dewatering filter and from there to a storage tower, from which the pulp is transported to a paper machine, for instance.

The reject pulp is passed back in the process in the form of a suspension and is caused to pass through a refiner and then through a slusher, whereafter it is finally introduced into the main pulp suspension flow, preferably upstream of and in the vicinity of the storage vessel (latency chest) or directly into the storage vessel (latency chest) itself.

In a preferred embodiment of the invention, bleaching agent is added to the reject pulp suspension at a location downstream of the refiner in the circuit and prior to said reject pulp suspension being introduced into the main pulp suspension flow.

The bleaching agent may be an oxidizing bleaching agent, for instance some peroxide, such as hydrogen peroxide, although it is preferred that the bleaching agent is a reducing bleaching agent, for instance dithionite. The bleaching agent is suitably delivered to the reject pulp suspension in a pump located just downstream of the slusher in the circuit. Alternatively, the bleaching agent may be added in the conduit between the refiner and the slusher or in the actual slusher itself.

ADVANTAGES

The use of the bleaching agent in accordance with the invention leads to a very good bleaching response, in other words to a very high bleaching effect. This can be utilized in several ways. For instance, only a minimum amount of bleaching agent need be added to achieve a given brightness. This results in low bleaching costs which, in turn, contribute towards keeping down the total pulp manufacturing costs. It also means that a given bleaching agent charge will result in a pulp of greater brightness than when employing conventional technology. A comparatively very high pulp brightness than when employing conventional technology. A comparative very high pulp brightness is achieved with a high bleaching agent charge, which can be desired in respect of the manufacture of certain types of paper. By further bleaching the pulp that has been manufactured in accordance with the invention, for instance with an oxidizing bleaching agent, it can be possible to manufacture a mechanical pulp that has a surprisingly high final brightness.

BEST EMBODIMENT

Figure 1:
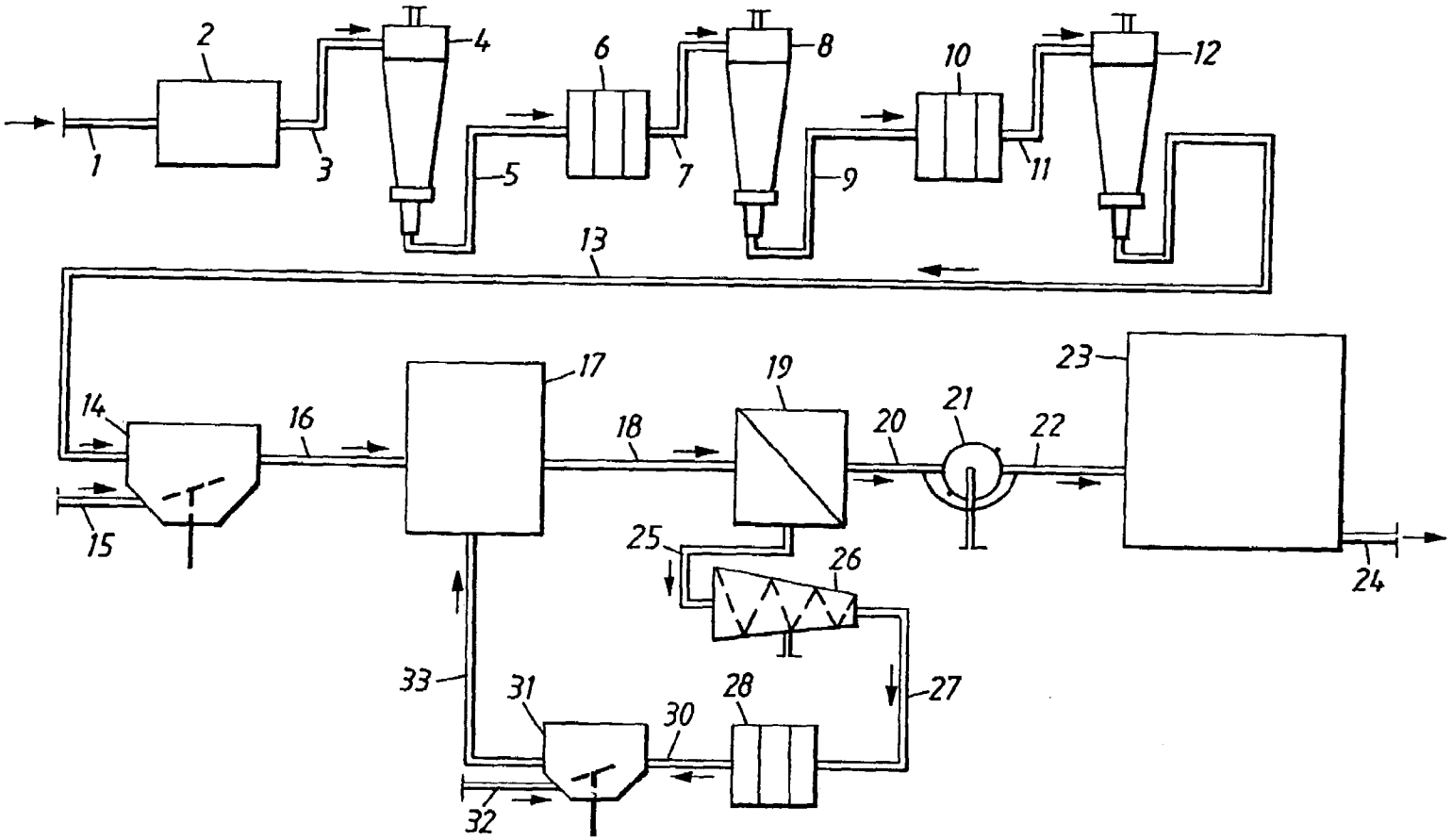
FIG. 1 of the accompanying drawing is a flow sheet showing the manufacture of the bleached thermomechanical pulp.

There will now be described with reference to the flow sheet of FIG. 1 partly the manufacture of bleached thermomechanical pulp in accordance with known technology and partly the manufacture of bleached thermomechanical pulp in accordance with the invention, including preferred embodiments thereof. Six examples are given at the end of this description, one being in accordance with known technology and the remainder in accordance with the invention.

Suitable lignocellulosic material, for instance wood in chip form, is fed through the conduit 1 to the preheater 2. The starting material, i.e. some sort of tree, is cut into suitable lengths (logs) which are then barked in a barking drum for instance and thereafter passed to a chipper in which the lengths of wood (the logs) are chipped. The chips may then be screened to obtain chips of an appropriate size, whereafter the chips are processed to form pulp. The chips may optionally be steamed and washed. None of these manufacturing stages just mentioned has been shown in the accompanying flow sheet.

The wood chips are preheated in the vessel 2 to a temperature of slightly more than 100° C. for instance, and at a steam pressure of 50 kPa for instance over a flow time of 3 minutes, for instance.

The preheated chips are fed through the conduit 3 to a cyclone 4 in which surplus steam is removed from the chips and the chips are then fed into the refiner 6 via the conduit 5. Commercially available refiners have been described in the introductory passages of this document. The chips are subjected in the refiner 5 to elevated pressure, e.g. 300–600 kPa, and to elevated temperature, e.g. 130-160° C. As the chips are caused to pass through the space (gap) between the refining discs, of which one is stationary and one rotates at high speeds for example, the wood fibres are defibrated essentially such as to result in a pulp in form of a pulp suspension. The pulp consistency may lie at about 40%. The coarseness of the pulp is determined by the defibration energy to which the chips are subjected. The specific energy input in the first refiner will normally lie within the range of 700-1200 kWh per tonne of dry lignocellulose material, in this case wood. When pulp is referred to as having a given coarseness, it is meant that the fibres have not been defibrated to one hundred percent and that the pulp will contain a significant amount of material that has not been completely defibered, this material being in the form of knots and other fibre agglomerates that contain varying numbers of interconnected fibres. The coarseness of the pulp is determined and given a freeness number. The most common freeness number is the CSF number, CSF standing for "Canadian Standard Freeness".

The pulp suspension is passed through the conduit 7 to a cyclone 8 in which the pulp suspension is freed from surplus steam. The pulp suspension, which has a pulp consistency of about 40%, is then passed to a second refiner 10 through the conduit 9. The pressure in this refiner may also be 300–600 kPa and the temperature 130-160° C. The energy input of this second refiner 10 is normally kept lower than in the case of the first refiner 6 and will normally lie within the range of 500-1000 kWh per tonne of dry pulp.

The pulp suspension defibered in a second stage is passed through the conduit 11 to a cyclone 12 in which the suspension is freed from surplus steam, said pulp being much less coarse and thus having a much lower freeness number than the pulp leaving the first defibration stage. The pulp suspension is then passed to a slusher (latency pulper) 14 through the conduit 13, which may consist of a screw conveyor. The pulp suspension fed into the slusher may have a pulp consistency of about 40% which is decreased in the slusher 14 to about 2-4% for instance with the aid of white water delivered through the conduit 15. The temperature in the slusher 14 will normally be from 80 to 95° C. and the residence time will normally be 2-5 minutes. The pulp suspension is passed from the slusher 14 at said pulp concentration to the storage vessel (latency chest) 17, via the conduit 16. Further white water can be delivered to the pulp suspension at the described location (not shown in the drawing) so as to further decrease the pulp consistency, for instance by 0.5-1%. The temperature in the latency chest 17 is normally 70-80° C. and the residence time is longer than the residence time in the slusher 14 and will normally be from 10 to 30 minutes. The pulp fibres are allowed to straighten out in the latency chest 17.

The pulp suspension is fed from the latency chest 17 to the screening department 19 through the conduit 18 at a pulp consistency of 2.5% for instance. It is preferred that the pulp consistency will be very low in the screening department, i.e. a consistency of below 1%, and it is therefore necessary to add further white water to the pulp suspension. The white water addition can be made in the conduit 18 or in the screening department 19 (not shown in the drawing). The pulp accepted in the screening process, i.e. the accept pulp suspension, is passed through the conduit 20 to a dewatering filter 21 at a pulp consistency of less than 1%, said consistency being raised to, e.g., 10% in the filter 21. The pulp suspension is passed from the dewatering filter 21 to the storage tower 23 through the conduit 22. Although not shown in the drawing, the pulp suspension is diluted with white water on its passage to the storage tower 23 or in said storage tower itself, so as to obtain a pulp consistency of 4-5%, for instance. The pulp suspension is passed from the storage tower 23 to a paper machine for instance through the conduit 24, as required.

Certain plants include a finished pulp vessel (not shown in the drawing) placed somewhere between the dewatering filter 21 and the storage tower 23. In such cases, the pulp suspension can be diluted with white water in said location in two stages, i.e. both upstream of or in the finished pulp vessel, so as to obtain a temporary pulp consistency of about 5-6%, and downstream of said finished pulp vessel or in the storage tower 23 itself so as to obtain a pulp consistency of about 4-4.5% in said storage tower 23. The temperature in the storage tower 23 may be about 60° C.

The reject pulp suspension is passed from the screening department 19 to a screw press 26 via the conduit 25 at a pulp consistency of about 4%. The reason why this pulp suspension flow has such a comparatively high pulp consistency is because the reject pulp is caused to pass through a curved screen (not shown in the drawing) in an ultimate screening stage for instance, therewith raising the pulp consistency from below 1% to about 4%. The pulp consistency of the reject pulp suspension is raised to above 30% in the screw press 26 and, for instance, as high as 35%.

The reject pulp suspension is fed to the refiner 28 at this high pulp consistency, via the conduit 27. The pressure in this refiner is comparatively low, for instance a water vapour pressure of 150 kPa while the prevailing refiner temperature is about 110° C. The energy input of the reject refiner 28 would normally range from 1000-1400 kWh per tonne of dry reject pulp. Subsequent to defibration, the reject pulp suspension is passed to the slusher 31 through the conduit 30. The incoming pulp suspension has a pulp consistency of about 35%, which is then lowered to, e.g., about 3% by adding white water through the conduit 32. The temperature in the slusher 31 is about 85-90° C. and the flow time, or residence time, is from 2-4 minutes, for instance. The reject pulp suspension is then passed to the latency chest 17, through the conduit 33. Alternatively, the flow of reject pulp suspension can be fed to the conduit 16.

Hitherto, bleaching of thermomechanical pulp has not been mentioned. According to known technology, such bleaching can be effected in at least a couple of ways. In one known method, a reductive bleaching agent, for instance sodium dithionite, is added to the pulp suspension in the form of an aqueous solution immediately upstream of or in the finished pulp vessel (when such a vessel is used) or immediately upstream of or in the storage tower 23. In this location, the temperature is normally within the range of 40-60° C. for instance, which has hitherto been considered to be the optimal range for a good bleaching result. The storage tower has furthermore a large volumetric capacity and, as the name implies, is a tower, which has certain similarities with a bleaching tower, sometimes used in conventional bleaching process. It is known in such bleaching process to add a complexing agent to the system and also to exclude such an addition. When the bleaching process includes the addition of a complexing agent, the complexing agent may be added immediately upstream of or in the first refiner 6, or immediately upstream of or in the second refiner 10, or at both of these locations.

Distinct from the known technology, any known reductive bleaching agent may be added to the pulp suspension in accordance with the inventive method, although with dithionite being a preferred bleaching agent, somewhere between the location 10, i.e. the second refiner, and the location 19, i.e. the screening department. When defibration is effected in only one stage, the bleaching agent is delivered to the pulp suspension somewhere between location 6, i.e. the first refiner, and location 19, i.e. the screening department.

There are a number of preferred addition locations. Most preferably, the bleaching agent is added in the form of an aqueous solution in the pulp pump located at the outlet of the slusher 14 (not shown in the drawing), said pump functioning to feed the pulp suspension, which has a pulp consistency of 2-4% for instance, to the latency chest 17 through the conduit 16. At this system location, the pulp suspension will normally have a temperature of 80-95° C., this high temperature probably being one of the explanations as to why an extremely good bleaching result is obtained when adding the bleaching agent in the described location. Another reason may be that the pump functions as a good mixer, i.e. causes the bleaching agent to be distributed quickly and uniformly throughout the pulp suspension. Furthermore there is a theory that the bleaching agent shall be added to the pulp suspension relatively quickly after the fibre defibration, therewith minimizing the negative effect of atmospheric oxygen on certain chromophore groups in the pulp. In other words, the bleaching agent is able to render these groups harmless before they are permeated by the atmospheric oxygen. This is precisely the case with the inventive method, as will be evident from the foregoing.

Other preferred addition locations are: in the conduit or screw conveyor 13 upstream of the slusher 14; directly in the slusher 14; or by mixing the bleaching agent with the white water that is normally delivered to the slusher 14 via the conduit 15.

The reductive bleaching agent may alternatively be added in the latency chest 17 and, for instance, in the pump (not shown in the drawing) positioned immediately to the right of the latency chest 17 and functioning to transport the pulp suspension to the screening department 19, even though these addition locations are not preferred locations. The reductive bleaching agent may alternatively be added already in the conduit 7 when, for instance, only one refiner is used, or in the conduit 11 when two refiners are used.

Although it is preferred to add the bleaching agent at a location in which the pulp concentration is low, for instance 2-4%, implying that essentially centrifugal pulp pumps are required to transport the advancing pulp suspension, it is fully possible to allow the pulp concentration to be as high as 15% or more at the described addition locations, while advancing the pulp suspension with the aid of pumps for medium pulp consistencies. A good bleaching response is also obtained with such an inventive method.

According to one preferred embodiment of the invention, a complexing agent is added to the lignocellulose material (the wood) and/or the pulp suspension at one or more locations. For instance, the complexing agent can be added to the wood by supplying the chemical concerned in the cyclone 4. The cyclone 8 is another suitable addition location. Naturally, the complexing agent may be added in both of these locations or in the same location as that in which the bleaching liquor is delivered to the pulp suspension, optionally in mixture with said bleaching liquor. Suitable complexing agents and suitable addition charges or quantities have been mentioned earlier in this document. The addition of complexing agents in the manufacture of bleached thermomechanical pulp for instance is known to the art.

According to the invention, it is fully possible to restrict bleaching of the pulp to the hitherto described limit, that is to say without bleaching the flow of reject pulp taken from the screening department 19 via the conduit 25 and returning this reject pulp to the main pulp flow via the conduit 33, for instance in the latency chest 17.

However, the reject pulp may alternatively be bleached prior to its introduction into the main pulp flow. This bleaching process may be effected with both an oxidizing and a reducing bleaching agent.

It is particularly preferred to carry out the bleaching with a reductive bleaching agent, for instance with dithionite. The bleaching agent addition location most preferred is in the pump (not shown in the drawing), which is situated at the pulp suspension outfeed location from the slusher 31. Other preferred bleaching agent addition locations are: in the conduit 30 upstream of the slusher 31; directly in the slusher 31; and by mixing the bleaching agent in the white water that is normally delivered to the slusher 31 through the conduit 32.

In order to achieve truly high final brightnesses, it is suitable to add bleaching agent at three positions, i.e. a reductive bleaching agent in the earlier mentioned locations relatively early in the advancement of the main pulp suspension plus a reductive or oxidizing bleaching agent to the reject pulp suspension flow, plus a reducing or oxidizing bleaching agent late in the advancement of the main pulp suspension, for instance at or in the finished pulp vessel and at or in the storage tower.

The manufacture of bleached chemithermomechanical pulp, which is also included by the invention, coincides to a large extent with the aforedescribed. The largest and practically the sole difference resides in the substitution of the chip preheating vessel 2 with an impregnation device, for instance a so-called PREX impregnator, in which a sodium sulfite solution having a relatively low $Na_2SO_3$ content per liter of solution is normally supplied to the chips. A number of other chemicals may also be supplied to the chips at this system location, such as a complexing agent for instance. The chips are permitted to react with said chemical or chemicals over a relatively short period of time at an elevated temperature and in a steam atmosphere, whereafter the chips are passed to a cyclone for instance, and from there to a refiner in which the chips are defibered, and so on. This pulp of type CTMP is bleached in the aforedescribed manner in accordance with the invention.

Example 1

Barked spruce wood of Scandinavian origin was chopped into chips, screened, steamed and washed and then passed to the preheater 2 through the conduit 1. A steam pressure of 50 kPa prevailed in the preheater. The wood chips were then passed from the preheater 2 to a first refiner 6 via the cyclone 4, i.e. the steam separator. The complexing agent EDTA was delivered to the chips in the cyclone 4 in an amount (charge) corresponding to 0.4 kg per tonne of dry wood. The chemical was added in aqueous solution containing 400 g/l, and the solution was added at a flow rate corresponding to the aforesaid charge.

The refiner 6 was a Julhävaara SD62 refiner. The pressure in the refiner was 450 kPa and the energy input was 1100 kWh/tonne of dry wood. Subsequent to refining or defibration, the pulp suspension had a consistency of about 40% and the pulp freeness was determined as about 400 CSF. The pulp suspension was passed to a second Jylhävaara SD62-type refiner 10 via the cyclone 8 in which surplus steam was removed. This refiner also had a pressure of 450 kPa and an energy input of 730 kWh/tonne dry pulp. The pulp suspension fed from the refiner 10 had a consistency of about 40% and a freeness of 130 CSF.

This pulp suspension was passed to the slusher 14 and white water was added so as to obtain a pulp consistency of 3%. The temperature in the slusher 14 was within the range of 85-90° C. and the pulp suspension flow time or residence time was 3 minutes.

The pulp suspension was then transported (pumped) to the latency chest 17. Further white water was added, so as to lower the pulp consistency in the latency chest 17 to 2.5%. The temperature fell slightly and lay within the range of 70-75° C. The pulp suspension flow time or residence time was 20 minutes. The temperature of the pulp suspension naturally falls with the distance and time lapse from the second defibering stage, i.e. the defibration in the refiner 10.

The pulp suspension was then transported (pumped) to the screening department 19. The pulp suspension was divided into two flows. The flow of accept pulp suspension comprised about 60% of the starting pulp and the flow of reject pulp suspension corresponded to about 40% of this starting pulp. The accept pulp was passed at a pulp consistency of 0.5% to the dewatering filter 21, where said consistency was raised to 10%. The pulp suspension was then transported to a finished pulp vessel. White water was added to the suspension so as to obtain a pulp consistency in the finished pulp vessel of 5.5%. The temperature was within the range of 60-65° C. The pulp suspension was then pumped to the storage tower 23 and further white water was added, so as to lower the pulp consistency to 4%. The temperature in the storage tower 23 was about 60° C.

There was delivered to the pump at the outlet from the finished pulp vessel an aqueous solution of sodium dithionite with a concentration of 60 g/l at a rate of flow corresponding to a bleaching agent charge of 6 kg per tonne of dry pulp. The temperature of the pulp suspension at this location was about 60° C. and its pH-value was 5.0. No bleaching agent was added to the flow of reject pulp. Instead, the reject pulp flow was treated entirely in accordance with what can be seen from the flow sheet of FIG. 1, and was finally fed into the latency chest 17 with no bleaching agent addition as before mentioned.

Immediately downstream of the location 10, the brightness of the pulp was 61% ISO determined in accordance with the measurement method SCAN P3:93. When leaving the storage tower 23, the bleached pulp had a brightness of 67% ISO. Thus, the brightness of the pulp was increased by 6% ISO brightness units as a result of adding 6 kg sodium dithionite per tonne of dry pulp at the described location.

This example illustrates the application of conventional technology and constitutes a reference example.

Example 2

The aforedescribed test was repeated, but with two differences. One difference comprised adding a sodium dithionite solution in the pump immediately downstream of the slusher 14, instead of adding a similar solution in the pump immediately downstream of the finished pulp vessel. The temperature of the pulp suspension at this location was 87° C. and its pH value was 4.6. The sodium dithionite was charged in an amount corresponding to 4 kg per tonne of dry pulp.

The second difference comprised adding no complexing agent to the wood chips at location 4.

In this test, the brightness of the pulp immediately downstream of location 10 was 59% ISO and the brightness of the finished pulp (i.e. when the pulp had left the storage tower 23) was 67% ISO. Thus, a comparatively low charge of dithionite as small as 4 kg per tonne of dry pulp surprisingly resulted in an increase in brightness, more specifically in an increase of 8% ISO brightness units.

Example 3

The test according to Example 2 was repeated but with the difference that the complexing agent EDTA was added to the chips at location 4 in an amount corresponding to 1 kg per tonne of dry wood.

As a result of this addition of complexing agent, the brightness of the pulp immediately downstream of location 10 increased by 1% to 60% ISO. The finished pulp had a brightness of 68.8% ISO, i.e. an increase in pulp brightness of fully 8.8% ISO brightness units caused solely by the bleaching agent and then with a bleaching agent charge as low as 4 kg per tonne of dry pulp.

Example 4

This test was carried out in accordance with a preferred embodiment of the invention. The test according to Example 3 was repeated in full, although with the exception of an additional step in which sodium dithionite bleaching agent was also added to the flow of reject pulp, which constituted 40% of the main pulp flow. Sodium dithionite solution was delivered to the pump at the outlet from the slusher 31 in a concentration of 60 g/l and at a flow rate such as to achieve a charge of 6 kg sodium dithionite per tonne of dry pulp. The temperature of the pulp suspension at this location was 85° C. and its pH was 5.1. The pulp consistency was 3%. The brightness of the pulp immediately downstream of location 10 was 62.5% ISO.

The brightness of the finished pulp, i.e. in the conduit 24, was 72.3% ISO. The brightness of the pulp was increased by 9.8% ISO brightness units, with a total addition of 6.4 kg sodium dithionite per tonne of dry pulp.

Example 5

The test according to Example 4 was repeated but with the lone difference of lowering the sodium dithionite charge immediately downstream of location 14 from 4 kg per tonne of dry pulp to 2 kg per tonne of dry pulp. The brightness of the pulp immediately downstream of location 10 was 62.5% ISO. The brightness of the finished pulp was 69.2% ISO. A total charge of the bleaching agent sodium dithionite as low as 4.4 kg per tonne of dry pulp resulted in an increase in brightness of 6.7% ISO brightness units.

Example 6

The test according to Example 4 was repeated but with the lone difference that the bleaching agent sodium dithionite in the form of an aqueous solution and containing 60 g $Na_2S_2O_4$ per liter was also added in the pump from the finished pulp vessel at a rate of flow such as to obtain a bleaching agent charge of 4 kg per tonne of dry pulp at this location.

The brightness of the pulp immediately downstream of location 10 was 60.5% ISO.

The brightness of the finished pulp, i.e. in the conduit 24, was 74.5% ISO, which is a high degree of brightness in respect of thermomechanical pulp bleached solely with sodium dithionite. The brightness of the pulp was increased by 14% ISO brightness units, with a total charge of 10.4 kg sodium dithionite per tonne of dry pulp divided between the three addition locations in the pump immediately downstream of the slusher 14, in the pump and the outlet from the slusher 31, and in the pump immediately downstream of the finished pulp vessel.

What is claimed is:

1. A method for manufacturing bleached mechanical and chemithermomechanical pulp wherein a starting material in form of lignocellulose material, preferably wood in chip form, is caused to pass through at least one preheater or through a chemical treatment system, and a steam separator, and then through a single refining stage containing one refiner or two refiners with each refiner in the single refining stage being directly followed by steam separation and with only steam separation existing between refiners, in which the lignocellulose material is converted to a pulp suspension which, subsequent to the most downstream of said steam separation, is passed at least to one storage vessel and to a screening department from which the major part of the pulp suspension is taken out as an essentially finished bleached product or is taken out and passed to further treatment stages; and in which reductive bleaching agent as the only bleaching agent is added to the advancing pulp suspension without the use of a bleaching tower, wherein the improvement comprises adding the bleaching agent at a location downstream of the most downstream refiner and upstream of the screening department; and bleaching said pulp under at a temperature of from 80 to 95° C. and a minimized oxygen access condition at said location and immediately downstream of said location.

2. A method according to claim 1, characterized by adding complexing agent to the lignocellulose material upstream of and/or in said refiner.

3. A method according to claim 1, characterized by passing the pulp suspension to two refiners in series.

4. A method according to claim 3 characterized by adding complexing agent to the pulp suspension immediately upstream of and/or in said second refiner.

5. A method according to claim 1, characterized by also passing the pulp suspension to a slusher (latency pulper) located immediately upstream of the storage vessel (the latency chest).

6. A method according to claim 5, characterized by adding the bleaching agent to the pulp suspension in a pump located in connection with the slusher, said pump being caused to transport the pulp suspension to the storage vessel in a pipe.

7. A method according to claim 1, characterized by causing reject pulp suspension from the screening department to pass through a refiner and thereafter through a slusher whereafter said reject pulp suspension is finally fed into the main pulp suspension flow, preferably upstream of and in connection with the storage vessel (the latency chest) or in the storage vessel (the latency chest).

8. A method according to claim 1, characterized in that the solid content or concentration is low at said location at which the bleaching agent is added.

9. A method according to claim 8, wherein the solid content or concentration is 2 to 4% at said location.

10. A method according to claim 1, characterized in that the bleaching agent is a dithionite.

11. A method for manufacturing bleached mechanical and chemithermomechanical pulp wherein a starting material in form of lignocellulose material, preferably wood in chip form, is caused to pass through at least one preheater or through a chemical treatment system, and a steam separator, and then through a single refining stage containing one refiner or two refiners with each refiner in the single refining stage being directly followed by steam separation and with only steam separation existing between refiners, in which the lignocellulose material is converted to a pulp suspension which, subsequent to the most downstream of said steam separation, is passed at least to one storage vessel and to a screening department from which the major part of the pulp suspension is taken out as an essentially finished bleached product or is taken out and passed to further treatment stages; and in which reductive bleaching agent as the only bleaching agent is added to the advancing pulp suspension without the use of a bleaching tower or like means, wherein the improvement comprises adding the bleaching agent at a location downstream of the most downstream refiner and upstream of the screening department; and reject pulp suspension from the screening department is passed through a refiner and thereafter through a slusher whereafter said reject pulp suspension is fed into the main pulp suspension flow upstream of and in connection with the storage vessel (the latency chest) or in the storage vessel (the latency chest); adding bleaching agent to the reject pulp suspension at a location downstream of the refiner in that circuit and prior to introducing the reject pulp suspension into the main pulp suspension flow; and bleaching said pulp under the conditions of a temperature of from 70° C. to 130° C. and minimized oxygen access at said location and immediately downstream of said location.

12. A method according to claim 11 characterized in that the bleaching agent is a reducing bleaching agent.

13. A method according to claim 11, characterized by adding the bleaching agent to the reject pulp suspension in a pump located in connection with the slusher in this circuit.

* * * * *